US007528553B2

(12) United States Patent
Ito et al.

(10) Patent No.: US 7,528,553 B2
(45) Date of Patent: May 5, 2009

(54) LIGHTING CONTROL APPARATUS FOR VEHICLE LIGHTING DEVICE

(75) Inventors: Masayasu Ito, Shizuoka (JP); Takanori Namba, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 135 days.

(21) Appl. No.: 11/656,842

(22) Filed: Jan. 23, 2007

(65) Prior Publication Data

US 2007/0170876 A1 Jul. 26, 2007

(30) Foreign Application Priority Data

Jan. 24, 2006 (JP) ..... 2006-015227

(51) Int. Cl.
*G05F 1/00* (2006.01)

(52) U.S. Cl. ..... 315/291; 315/307; 315/360; 315/294; 315/77

(58) Field of Classification Search ..... 315/77, 315/82, 291, 294, 295, 307, 308, 219, 225, 315/224, 312, 316, 360; 362/231, 294; 327/108, 327/380, 427; 307/10.1, 10.8
See application file for complete search history.

(56) References Cited

U.S. PATENT DOCUMENTS 7,274,150 B2 * 9/2007 Takeda et al. ..... 315/77
7,327,051 B2 * 2/2008 Ito et al. ..... 307/10.8
2005/0062481 A1 3/2005 Vaughn
2006/0057447 A1 * 3/2006 Yamase et al. ..... 429/23
2006/0170287 A1 * 8/2006 Ito et al. ..... 307/10.1
2007/0085494 A1 * 4/2007 Takeda et al. ..... 315/316

FOREIGN PATENT DOCUMENTS

DE 101 08 132-A 1 8/2002
DE 101 40 331-A 1 4/2003
EP 0434859-A 1 7/1991
JP 2004-134147 4/2004

OTHER PUBLICATIONS

German Office Action for German Patent Application No. 10 2007 003 575.8-31, dated Mar. 22, 2007, and English translation thereof, 10 pages.

* cited by examiner

*Primary Examiner*—Haissa Philogene
(74) *Attorney, Agent, or Firm*—Osha • Liang LLP

(57) ABSTRACT

A lighting control apparatus and a method of lighting control for a vehicle lighting device includes a semiconductor light source including a semiconductor light emitting element; and a current supply controller coupled between a power supply and the semiconductor light source. Supply of a current from the power supply to the semiconductor light source is restricted by the current supply controller during a current restriction period to a value smaller than a prescribed current. A microcomputer compares a forward voltage generated from the semiconductor light source during the current restriction period with an abnormality determination value to determine whether or not an abnormality occurs due to a change of the forward voltage of the semiconductor light source.

19 Claims, 9 Drawing Sheets

FIG. 4 (a)
FIG. 4 (b)
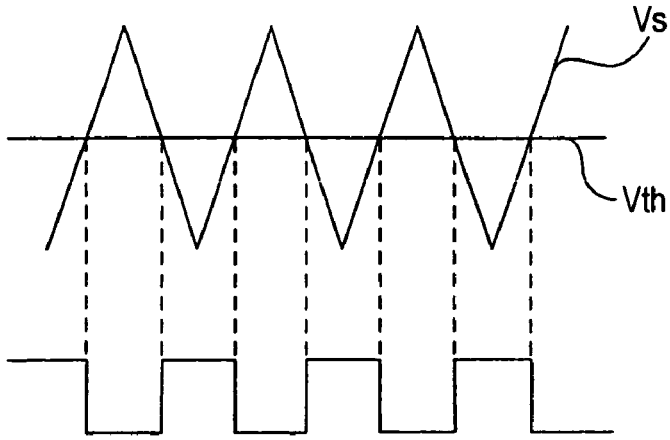
FIG. 4 (c)
FIG. 4 (d)
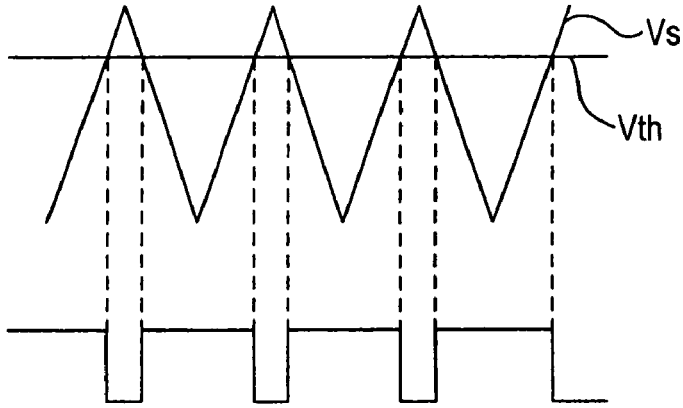
FIG. 4 (e)
FIG. 4 (f)
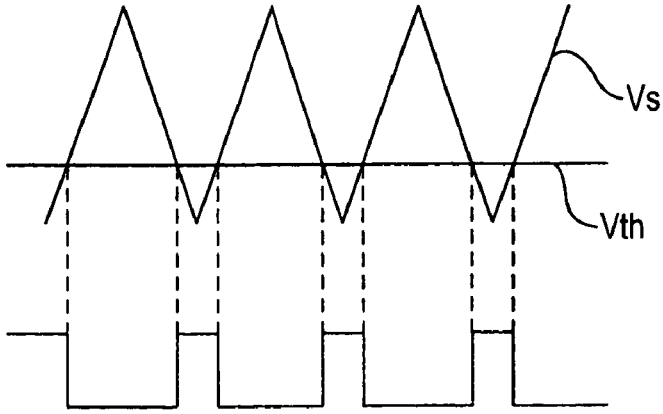

LIGHTING CONTROL APPARATUS FOR VEHICLE LIGHTING DEVICE

BACKGROUND OF INVENTION

1. Field of the Invention

The present invention relates to a lighting control apparatus and a method of lighting control for a vehicle lighting device and, in particular, relates to a lighting control apparatus and method of lighting control for a vehicle lighting device which is configured to control the lighting of a semiconductor light source constituted by a semiconductor light emitting element.

2. Background Art

There has been known a vehicle lighting device which employs a semiconductor light emitting element such as a light emitting diode (LED). In such a vehicle lighting device, a lighting control circuit for controlling the lighting of the LED is mounted.

In such a case, the lighting control circuits constituted of a configuration arranged in a manner that a plurality of LEDs are coupled in series to constitute a light source unit, a plurality of the light source units are coupled in parallel, the lighting control circuit is coupled to the both ends of the plurality of the light source units coupled in parallel, the lighting control circuit supplies the same current to all of the LEDs of the plurality of the light source units, and a resistor is inserted in series in each of the plurality of the light source units. In the case where a voltage across the both terminals of the resistor drops, for example, when the current stops flowing trough the resistor due to the breakage of one of the LEDs of the light source units and so the voltage across the both terminals of the resistor becomes 0 volts, one of the LEDs of the light source units is determined to be broken and the output voltage of a switching regulator constituting the lighting control circuit is reduced (see patent document 1). According to such a lighting control circuit, when one of the LEDs of the light source units is broken, the output voltage of the switching regulator is reduced, so that the output voltage of the switching regulator is prevented from being an overvoltage or excess voltage.

[Patent Document 1] JP-A-2004-134147 (pages 3 to 6, FIG. 1)

SUMMARY OF INVENTION

In the case of monitoring the voltages applied to the LEDs from the switching regulator to detect the abnormality due to a failure resulted from the short-circuit of the LED, such a configuration may be employed that the output voltage of the switching regulator is compared with a setting voltage, and when the output voltage of the switching regulator becomes smaller than the setting voltage, it is detected that a failure resulted from the short-circuit of the LED occurs. However, even if such a configuration is employed, a failure resulting from a short-circuit of the LED cannot be detected accurately without taking the variance of the forward voltage Vf of the LED into consideration.

For example, supposing that a multichip LED is used as the LED and five multichip LEDs each having a voltage drop, that is, a forward voltage Vf of 16 volts are coupled in series, the output voltage of the switching regulator becomes 80 volts, that is, the sum of the forward voltages of the five multichip LEDs. Although it is supposed that the forward voltage Vf of the multichip LED is 16 volts, the forward voltage Vf has variation. This variation is caused by "the VI characteristics of the multichip LED," "the temperature characteristics of the multichip LED," or "individual difference among the multichip LEDs," for example. In particular, the variance of the multichip LED due to the individual difference thereof is larger than that of a silicon diode, and some of the multichip LEDs have such a large variance in a range from +15% to −15% at 25 degrees centigrade and a rated current.

In this case, the sum of the forward voltages Vf of the five multichip LEDs varies in a range from 68 volts to 92 volts. When taking into account this variance, the output voltage range allowable as the output voltage of the switching regulator is in a range from 68 volts to 92 volts. In the case where the sum of the forward voltages Vf of the five multichip LEDs is 85 volts, for example, if one of the multichip LEDs fails due to a short-circuit caused by any reason and so the forward voltage Vf=16 volts of the failed multichip LED becomes 0 volt, the output voltage of the switching regulator becomes 69 volts even if the failure due to a short-circuit occurs as to the switching regulator which output voltage is 85 volts in a normal state. Because this output voltage is within an output voltage range (from 68 volts to 92 volts) allowed as the switching regulator, the failure due to a short-circuit cannot be detected by merely monitoring the output voltage of the switching regulator.

If a part of plurality of LEDs or multichip LEDs fails due to a short-circuit, for example, if an LED or a multichip LED is turned off due to a failure caused by a short-circuit thereof a lamp emits light as a whole despite the fact that the light distribution is not sufficient. Thus, a driver may not notice the abnormality and so may continue to drive under these conditions.

On the other hand, there is no guarantee that, as the abnormality of LEDs (including a multichip LED), it is sufficient to assume only the complete short-circuit (the forward voltage Vf is 0 volt) of an LED. For example, leak failure of an LED is considered as another abnormality and, in this case, the LED has a certain impedance. That is, when leak failure occurs in an LED, a forward voltage Vf according to the impedance is generated when the LED is supplied with a current. The forward voltage Vf is lower than a forward voltage in the normal state.

Further, as a failure relating to an LED, there could be a failure of a zener diode, which is coupled in parallel to a semiconductor chip constituting the LED, for protection from static electricity. Such a failure arises not only when an excessive static electricity is applied to the zener diode, but also, may arise when a voltage larger than a zener voltage is applied upon disconnection of a wire contacting the LED.

In any case, because an LED or a zener diode has a certain impedance, a forward voltage Vf according to the impedance is generated. In this case, because the forward voltage Vf is lower than a forward voltage in the normal state, there is no guarantee that it is sufficient to assume only the complete short-circuit. Instead, it is necessary to detect whether or not an LED or a zener diode is abnormal by taking into consideration that a forward voltage according to the impedance is generated.

One or more embodiments of the invention determine with a high accuracy whether or not an abnormality occurs due to the change of the forward voltage of a semiconductor light source.

In one aspect, one or more embodiments of the present invention include:

current supply control means for controlling supply of a current to a single semiconductor light source (or a plurality of semiconductor light sources each) including a semiconductor light emitting element;

current restriction period setting means for setting, to the current supply control means, a period for restricting the current to be supplied to the semiconductor light source to a value smaller than a prescribed current; and determination means for comparing a forward voltage generated from the semiconductor light source during the period set by the current restriction period setting means with an abnormality determination value to determine whether or not an abnormality occurs due to a change of the forward voltage of the semiconductor light source.

At the time of supplying a current to a single semiconductor light source (or a plurality of the semiconductor light sources each) including the semiconductor light emitting element, a period for restricting the current to be supplied to the semiconductor light source to a value smaller than the prescribed current is set, the forward voltage generated from the semiconductor light source during this period is compared with the abnormality determination value to determine whether or not an abnormality occurs due to a change of the forward voltage of the semiconductor light source. Thus, it can be determined with a high accuracy whether or not an abnormality occurs due to the change of the forward voltage of the semiconductor light source.

That is, for example, when a rated current flows to the semiconductor light source as the prescribed current, the change of the forward voltage of the semiconductor light source is small irrespective of the presence or non-presence of an abnormality. In contrast, when a current smaller than the prescribed current is supplied to the semiconductor light source, the change of the forward voltage of the normal semiconductor light source is small. However, with respect to the semiconductor light source in which an abnormality occurs, for example, the semiconductor light source in which leak failure occurs, the change of the forward voltage thereof increases in accordance with an impedance thereof. Thus, by determining based on the abnormality determination value whether or not the forward voltage of the semiconductor light source changes largely at the time of supplying the current smaller than the prescribed current to the semiconductor light source, it can be determined with a high accuracy whether or not an abnormality occurs due to the change of the forward voltage of the semiconductor light source.

In one aspect, one or more embodiments of the present invention include:

current supply control means for controlling supply of a current to a single semiconductor light source (or a plurality of semiconductor light sources each) including a semiconductor light emitting element and a static electricity protection element coupled in parallel to the semiconductor light emitting element;

current restriction period setting means for setting, to the current supply control means, a period for restricting the current to be supplied to the semiconductor light source to a value smaller than a prescribed current; and determination means for comparing a forward voltage generated from the semiconductor light source during the period set by the current restriction period setting means with an abnormality determination value to determine whether or not an abnormality occurs due to a change of the forward voltage of the semiconductor light source.

At the time of supplying a current to a single semiconductor light source (or a plurality of the semiconductor light sources each) including the semiconductor light emitting element and the static electricity protection element coupled in parallel to the semiconductor light emitting element, a period for restricting the current to be supplied to the semiconductor light source to a value smaller than the prescribed current is set, the forward voltage generated from the semiconductor light source during this period is compared with the abnormality determination value to determine whether or not an abnormality occurs due to a change of the forward voltage of the semiconductor light source. Thus, it can be determined with a high accuracy whether or not an abnormality occurs due to the change of the forward voltage of the semiconductor light source.

That is, for example, when a rated current flows to the semiconductor light source as the prescribed current, the change of the forward voltage of the semiconductor light source is small irrespective of the presence or non-presence of an abnormality. In contrast, when a current smaller than the prescribed current is supplied to the semiconductor light source, the change of the forward voltage of the normal semiconductor light source is small. However, with respect to the semiconductor light source in which an abnormality occurs, for example, the semiconductor light source in which leak failure occurs, the change of the forward voltage thereof increases in accordance with an impedance thereof. Thus, by determining based on the abnormality determination value whether or not the forward voltage of the semiconductor light source changes largely at the time of supplying the current smaller than the prescribed current to the semiconductor light source, it can be determined with a high accuracy whether or not an abnormality occurs due to the change of the forward voltage of the semiconductor light source. Further, even when the semiconductor light emitting element is normal, if an abnormality occurs at the static electricity protection element coupled in parallel to the semiconductor light emitting element, the voltage across the both terminals thereof reduces. In this case, because the voltage across the both terminals (forward voltage) of the static electricity protection element in which an abnormality occurs is regarded as the forward voltage of the semiconductor light emitting element, even when an abnormality occurs due to the change of the forward voltage of the static electricity protection element, it can be determined as an abnormality due to the change of the forward voltage of the semiconductor light source.

In one aspect, one or more embodiments of the present invention include:

current supply control means for controlling supply of a current to a single semiconductor light source (or a plurality of semiconductor light sources each) including a semiconductor light emitting element and a static electricity protection element coupled in parallel to the semiconductor light emitting element;

starting stop period setting means for setting, to the current supply control means, a starting stop period during which a supply of a current to the semiconductor light source is stopped;

auxiliary current supply means for supplying, during the starting stop time period, to the semiconductor light source, a current that flows through the static electricity protection element in a forward direction and flows through the semiconductor light emitting element in a backward direction and is smaller than a prescribed current; and determination means for comparing a forward voltage generated from the semiconductor light source during the starting stop period with an abnormality determination value to determine whether or not an abnormality occurs due to a change of the forward voltage of the semiconductor light source.

With respect to the current supply control means that controls the supply of a current to a single semiconductor light source (or a plurality of the semiconductor light sources each) including the semiconductor light emitting element and the static electricity protection element coupled in parallel to the semiconductor light emitting element, the starting stop period during which the supply of the current to the semiconductor light source is stopped is set. During the starting stop time period, a current is supplied to the semiconductor light source in a manner that this current flows through the static electricity protection element in the forward direction and flows through the semiconductor light emitting element in the backward direction and this current is smaller than the prescribed current. The forward voltage generated from the semiconductor light source during this period is compared with the abnormality determination value to determine whether or not an abnormality occurs due to a change of the forward voltage of the semiconductor light source. Thus, it can be determined with a high accuracy whether or not an abnormality occurs due to the change of the forward voltage of the semiconductor light source.

That is, for example, when the rated current flows to the static electricity protection element of the semiconductor light source as the prescribed current (forward current), the change of the forward voltage of the static electricity protection element is small irrespective of the presence or non-presence of an abnormality. In contrast, when a current smaller than the prescribed current is supplied to the static electricity protection element, the change of the forward voltage of the normal static electricity protection element is small. However, with respect to the static electricity protection element in which an abnormality occurs, for example, the static electricity protection element in which leak failure occurs, the change of the forward voltage thereof increases in accordance with an impedance thereof. Thus, by determining based on the abnormality determination value whether or not the forward voltage of the static electricity protection element changes largely at the time of supplying the current smaller than the prescribed current to the static electricity protection element, it can be determined with a high accuracy whether or not an abnormality occurs due to the change of the forward voltage of the static electricity protection element. Further, even when the static electricity protection element is normal, if an abnormality occurs in the semiconductor light emitting element coupled in parallel to the static electricity protection element, a reverse current flows through the semiconductor light emitting element and so the voltage across the both terminals thereof reduces. In this case, since the voltage across the both terminals (forward voltage) of the semiconductor light emitting element in which an abnormality occurs is regarded as the forward voltage of the static electricity protection element, it can be determined whether or not an abnormality occurs due to the change of the forward voltage of the semiconductor light emitting element.

In one aspect, in one or more embodiments of the present invention, the abnormality determination value is a value set based on a forward voltage when a forward current of the semiconductor light emitting element is in a region smaller than the prescribed current.

In the case where an abnormality occurs in the semiconductor light emitting element, when a current smaller than the prescribed current is supplied to the semiconductor light emitting element constituting the semiconductor light source, the change of the forward voltage of this semiconductor light emitting element becomes larger in accordance with an impedance thereof. Thus, in the case where a current smaller than the prescribed current is supplied to the semiconductor light emitting element, by using the abnormality determination value set based on the forward voltage of the semiconductor light emitting element in an abnormal state as the abnormality determination value for determining whether or not the forward voltage of the semiconductor light emitting element changes largely, it can be determined with a high accuracy whether or not an abnormality occurs due to the change of the forward voltage of the semiconductor light emitting element. Further, even when the semiconductor light emitting element is normal, if an abnormality occurs at the static electricity protection element coupled in parallel to the semiconductor light emitting element, the voltage across the both terminals thereof reduces. In this case, because the voltage across the both terminals (forward voltage) of the static electricity protection element in which an abnormality occurs is regarded as the forward voltage of the semiconductor light emitting element, it can be determined whether or not an abnormality occurs due to the change of the forward voltage of the static electricity protection element.

In one aspect, in one or more embodiments of the present invention, the abnormality determination value is a value set based on a forward voltage when a forward current of the static electricity protection element is in a region smaller than the prescribed current.

In the case where an abnormality occurs in the static electricity protection element, when a current (forward current) smaller than the prescribed current is supplied to the static electricity protection element constituting the semiconductor light source, the change of the forward voltage of this static electricity protection element becomes larger in accordance with an impedance thereof. Thus, in the case where a current (forward current) smaller than the prescribed current is supplied to the static electricity protection element, by using the abnormality determination value set based on the forward voltage of the static electricity protection element in an abnormal state as the abnormality determination value for determining whether or not the forward voltage of the static electricity protection element changes largely, it can be determined with a high accuracy whether or not an abnormality occurs due to the change of the forward voltage of the static electricity protection element. Further, even when the static electricity protection element is normal, if an abnormality occurs at the semiconductor light emitting element coupled in parallel to the static electricity protection element, a reverse current flows through the semiconductor light emitting element and so the voltage across the both terminals thereof reduces. In this case, since the voltage across the both terminals (forward voltage) of the semiconductor light emitting element at which an abnormality occurs is regarded as the forward voltage of the static electricity protection element, even by using the abnormality determination value set based on the forward voltage of the static electricity protection element in an abnormal state, it can be determined whether or not an abnormality occurs due to the change of the forward voltage of the semiconductor light emitting element.

Advantages of one or more embodiments of the present invention may include one or more of the following in any combination. In one or more embodiments of the present invention, it can be determined with a high accuracy whether or not an abnormality occurs due to the change of the forward voltage of the semiconductor light source.

In one or more embodiments of the present invention, it can be determined with a high accuracy whether or not an abnormality occurs due to the change of the forward voltage of the semiconductor light emitting element or the static electricity protection element.

In one or more embodiments of the present invention, it can be determined with a high accuracy whether or not an abnormality occurs due to the change of the forward voltage of the static electricity protection element or the semiconductor light emitting element.

Other aspects and advantages of the invention will be apparent from the following description and the appended claims.

BRIEF DESCRIPTION OF DRAWINGS

FIG. 4 shows waveform diagrams for explaining the operation of the control Circuit.

DETAILED DESCRIPTION

Figure 1:
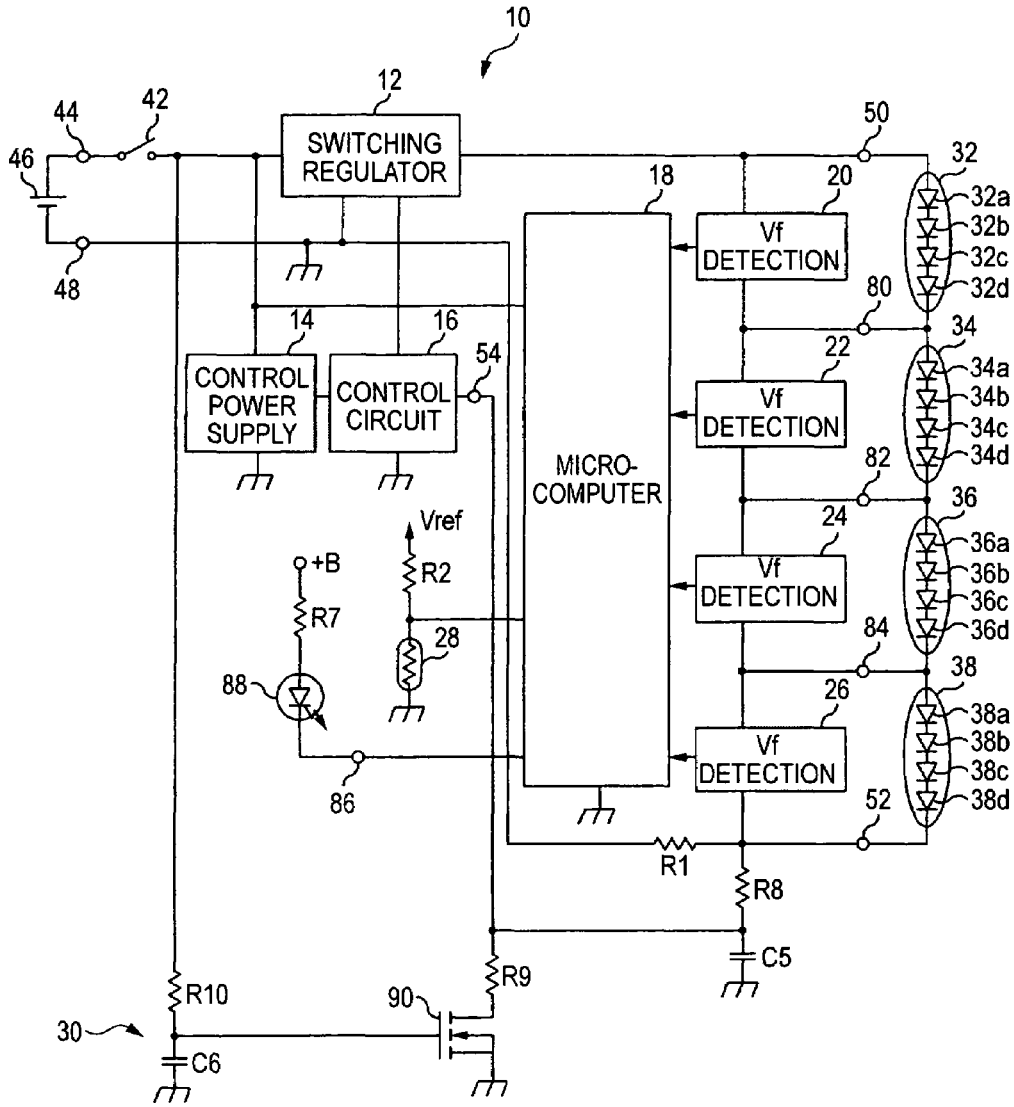
FIG. 1 is a circuit diagram of the lighting control apparatus for a vehicle lighting device according to the first embodiment of the invention.
Figure 5:
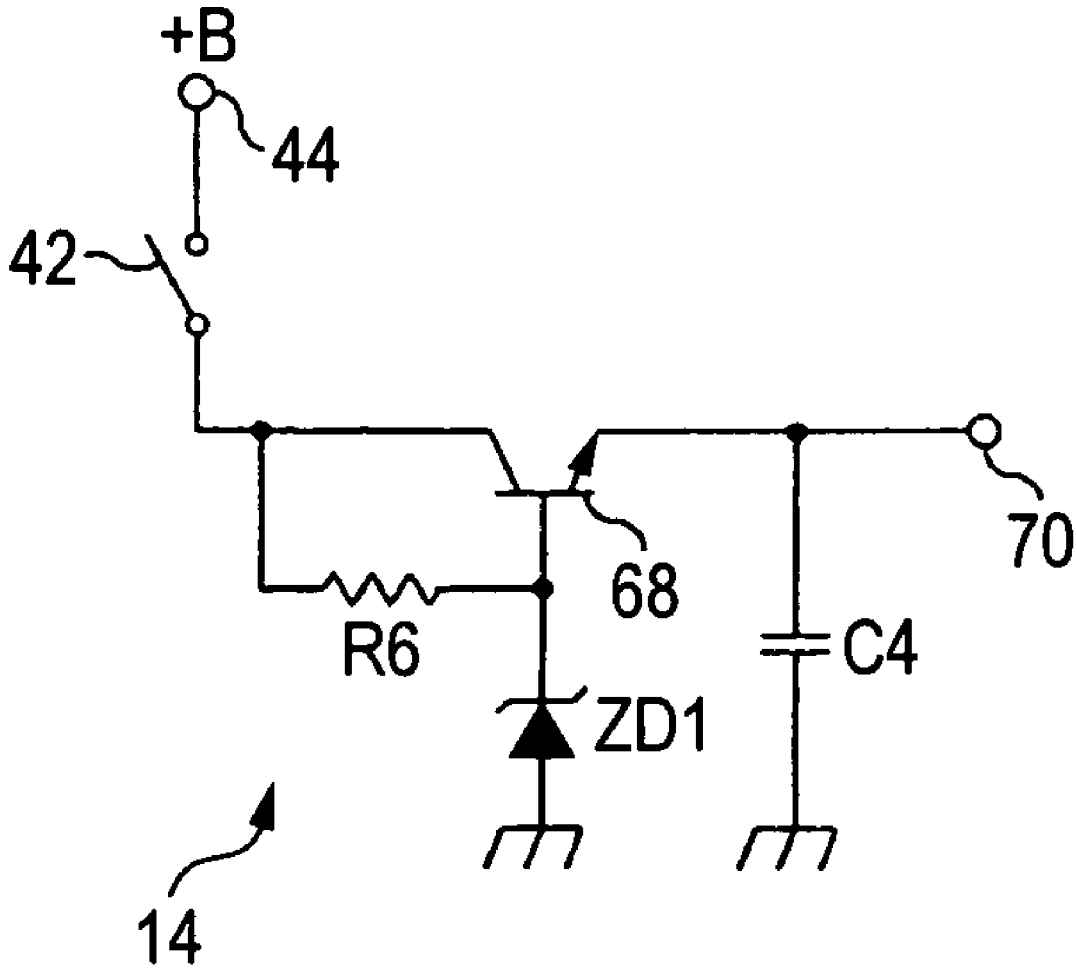
FIG. 5 is a circuit diagram of a control power supply.
Figure 6:
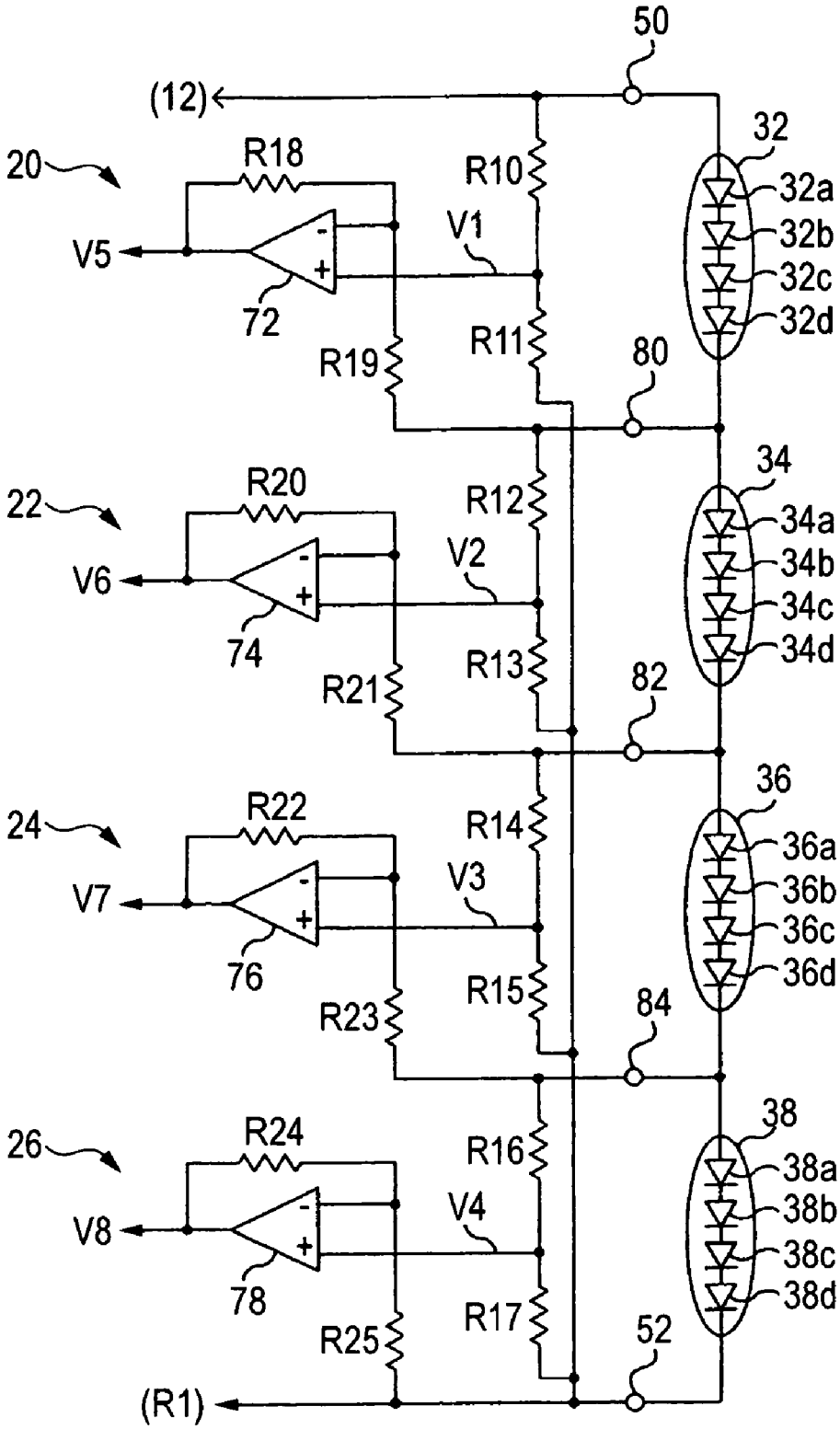
FIG. 6 is a circuit diagram of a forward voltage detection circuit.
Figure 8:
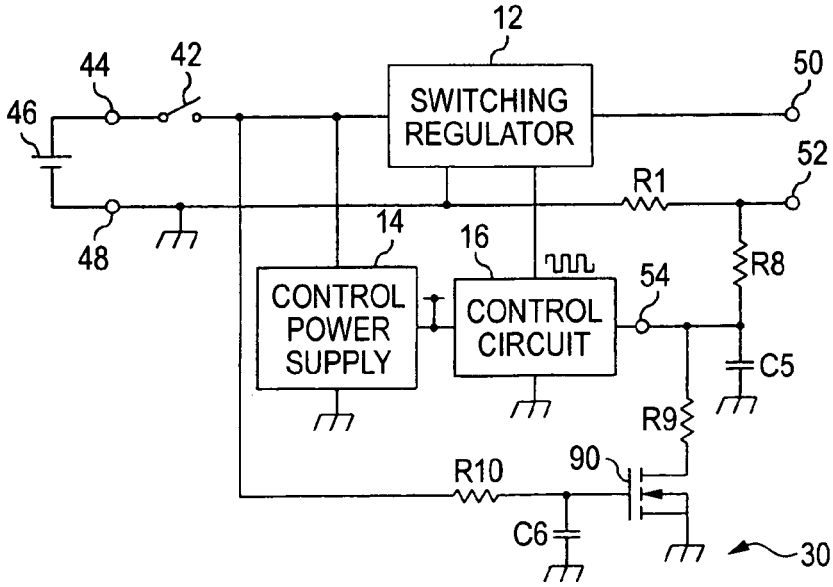
FIG. 8 is a circuit diagram for explaining the relation between a current restriction period setting circuit and the control circuit.
Figure 9:
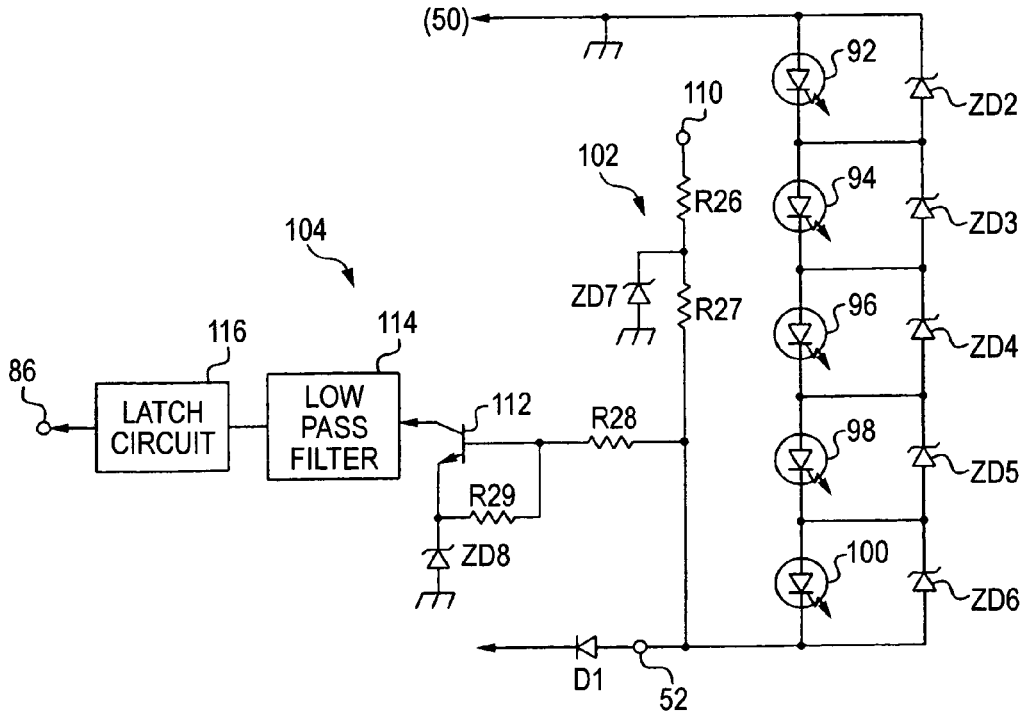
FIG. 9 is a circuit diagram of the main portion of the lighting control apparatus for a vehicle lighting device according to the second embodiment of the invention.
Figure 10:
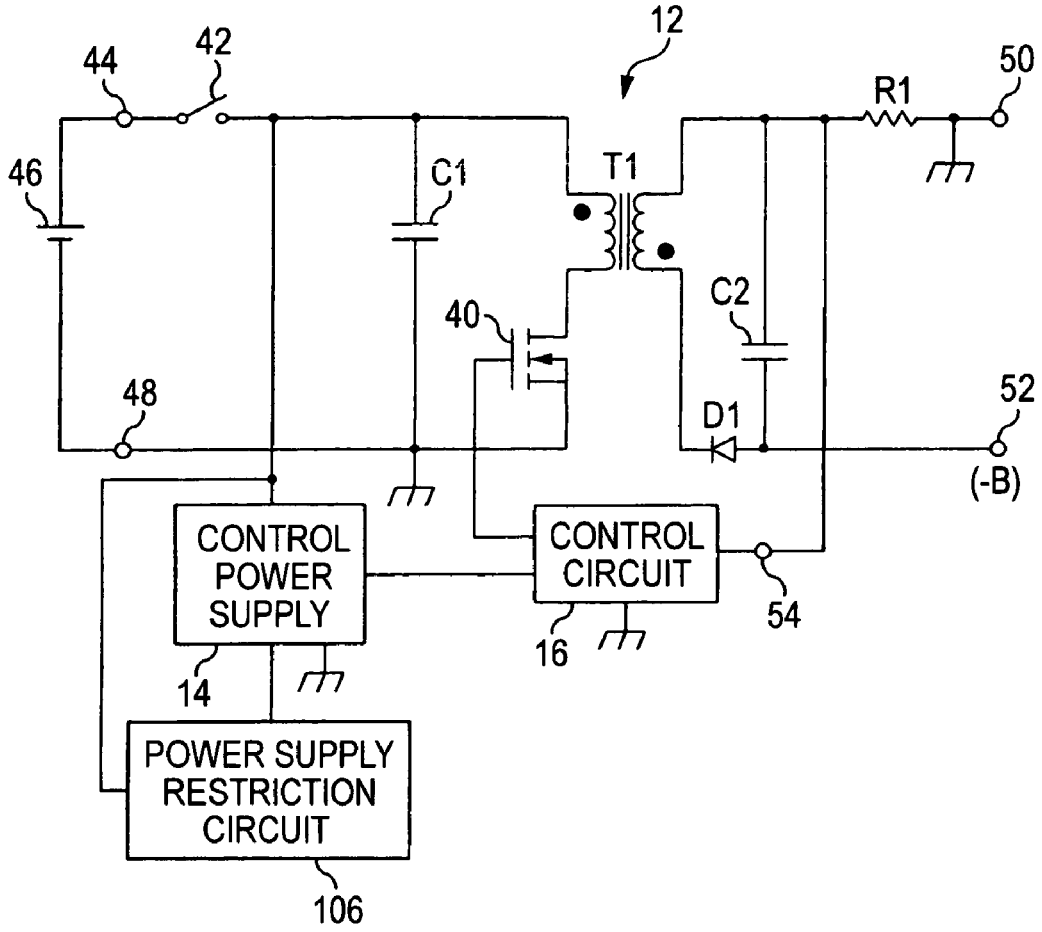
FIG. 10 is a circuit diagram for explaining the relation among the control power supply, the switching regulator and a power supply limit circuit.
Figure 11:
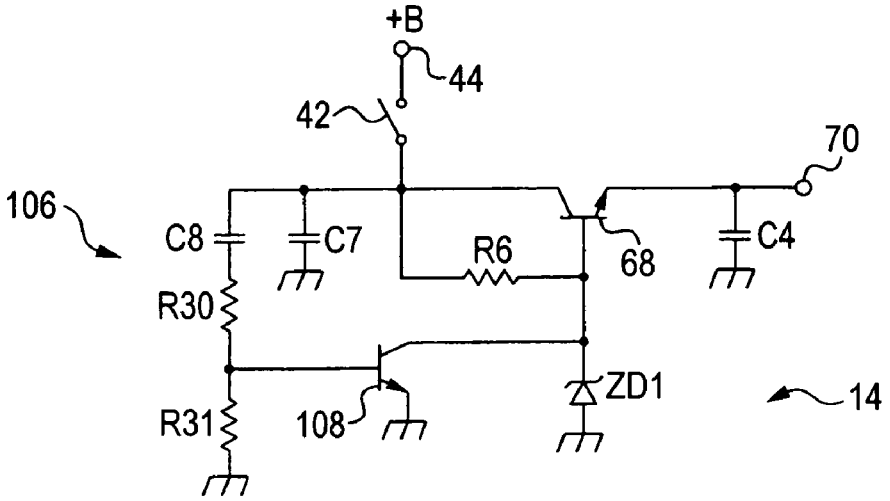
FIG. 11 is a circuit diagram for explaining the relation between the control power supply and the power supply limit circuit.

Next, embodiments of the invention will be explained. FIG. 1 is a circuit diagram of the lighting control apparatus for a vehicle lighting device according to an embodiment of the invention, FIG. 2 is a circuit diagram of a switching regulator, FIG. 3 is a circuit diagram of a control circuit, FIG. 4 shows waveform diagrams for explaining the operation of the control circuit, FIG. 5 is a circuit diagram of a control power supply, FIG. 6 is a circuit diagram of a forward voltage detection circuit, FIG. 7(*a*) is a characteristic diagram for explaining the Vf—If characteristics of an LED and an multichip LED in the case where an abnormality occurs in one LED, FIG. 7(*b*) is a characteristic diagram for explaining the Vf—If characteristics of an LED and an multichip LED in the case where an abnormality occurs in two LEDs, FIG. 8 is a circuit diagram for explaining the relation between a current restriction period setting circuit and the control circuit, FIG. 9 is a circuit diagram of the main portion of the lighting control apparatus for a vehicle lighting device according to another embodiment of the invention, FIG. 10 is a circuit diagram for explaining the relation among the control power supply, the switching regulator and a power supply limit circuit, and FIG. 11 is a circuit diagram for explaining the relation between the control power supply and the power supply limit circuit.

In these figures, as an element of the vehicle lighting device (light emitting apparatus), the lighting control apparatus 10 for a vehicle lighting device is configured as shown in FIG. 1 by a switching regulator 12, a control power supply 14, a control circuit 16, a microcomputer 18, forward voltage detection circuits 20, 22, 24, 26, a thermistor 28, a current restriction period setting circuit 30, a resistors R1 and a resistor R2. The switching regulator 12 is coupled to multichip LEDs 32, 34, 36, 38 serving as loads. The multichip LED 32 is formed by four LED chips 32*a*, 32*b*, 32*c* and 32*d* coupled in series and housed within a package, the multichip LED 34 is formed by four LED chips 34*a*, 34*b*, 34*c* and 34*d* coupled in series and housed within a package, the multichip LED 36 is formed by four LED chips 36*a*, 36*b*, 36*c* and 36*d* coupled in series and housed within a package, and the multichip LED 38 is formed by four LED chips 38*a*, 38*b*, 38*c* and 38*d* coupled in series and housed within a package. These LEDs are coupled in series to the output side of the switching regulator 12 as a semiconductor light source configured by semiconductor light emitting elements.

Alternatively, the multichip LEDs 32 to 38 may be configured in a manner that multichip LEDs coupled in series are formed as a power supply block and the respective power supply blocks are coupled in parallel or may be configured by one multichip LED. Further, alternatively, one single-chip LED or a plurality of single-chip LEDs may be used in place of one multichip LED or a plurality of multichip LEDs. Further, the multichip LEDs 32 to 38 may be configured as a light source for a various kinds of vehicle lighting devices such as a stop and tail lamp, a fog lamp, a turn-signal lamp.

Figure 2:
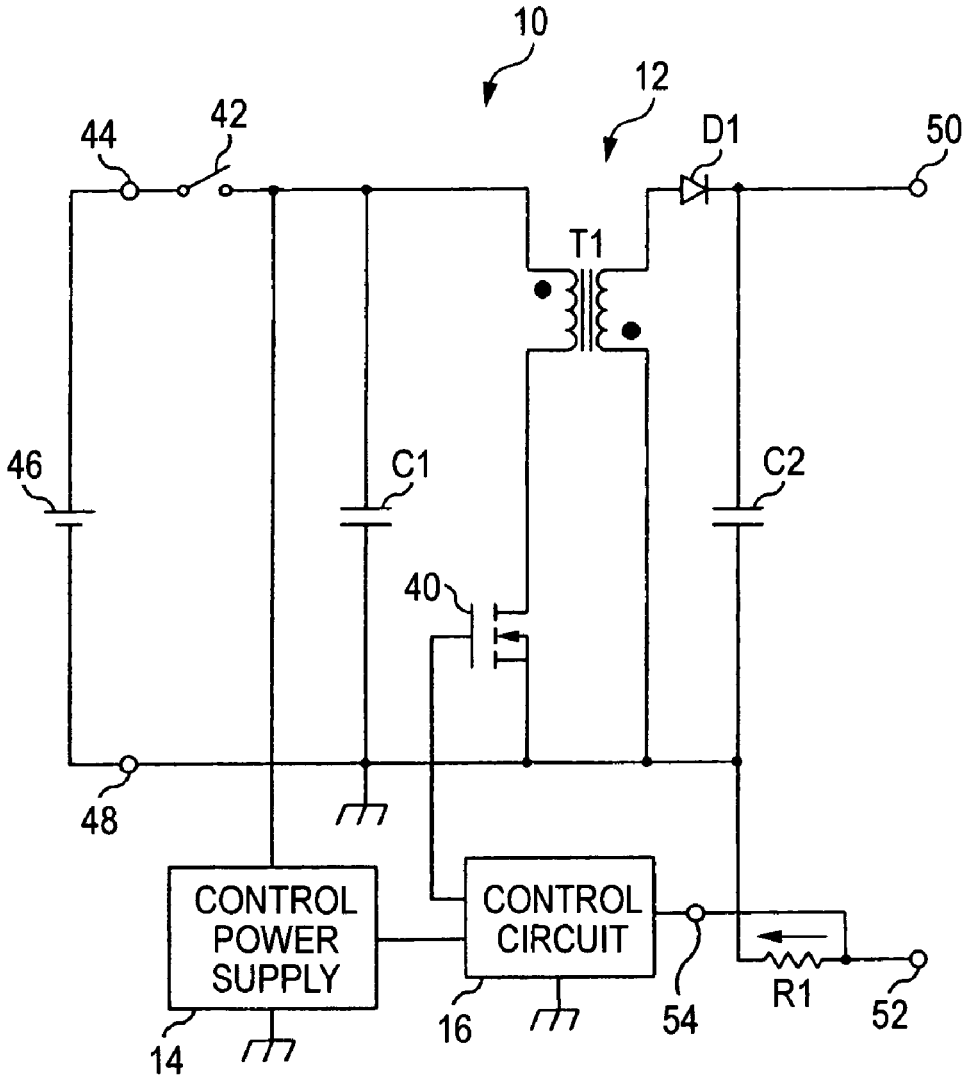
FIG. 2 is a circuit diagram of a switching regulator.
Figure 3:
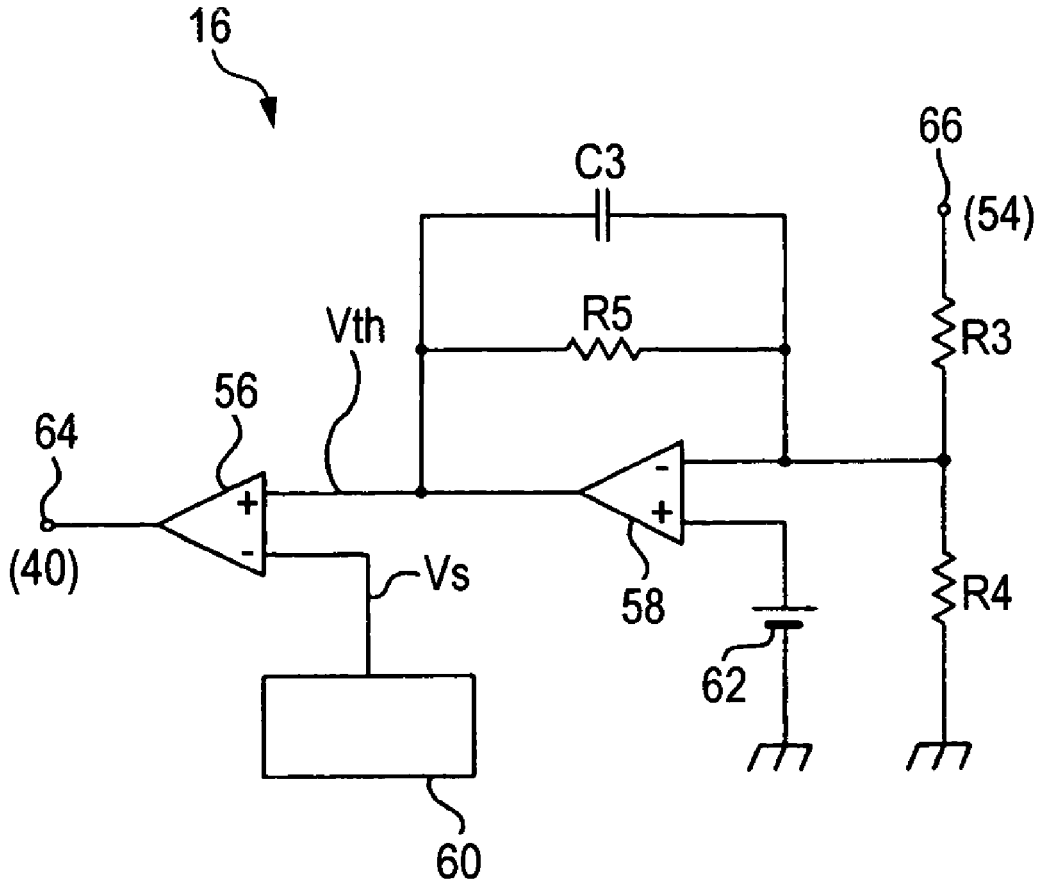
FIG. 3 is a circuit diagram of a control circuit.

As shown in FIG. 2, the switching regulator 12 includes a transformer T1, a capacitor C1, an NMOS transistor 40, a diode D1 and a capacitor C2.

On the primary winding side of the transformer T1, the capacitor C1 is coupled in parallel to the transformer and the NMOS transistor 40 is coupled in series thereto. The one end side of the capacitor C1 is coupled to the positive terminal of an on-vehicle battery (DC power supply) 46 via a power supply switch 42 and a power supply input terminal 44, and the other end of this capacitor is coupled to the negative terminal of the on-vehicle battery 46 via a power supply input terminal 48 and is grounded. The NMOS transistor 40 is arranged in a manner that the drain thereof is coupled to the primary winding side of the transformer T1, the source thereof is grounded and the gate thereof is coupled to the control circuit 16.

On the secondary winding side of the transformer T1, the capacitor C2 is coupled in parallel to the transformer via the diode D1. The coupling point between the capacitor C2 and the diode D1 is coupled to the anode side of the multichip LED 32 via an output terminal 50. The one end side of the secondary winding side of the transformer T1 is grounded together with the one end side of the capacitor C2 and is coupled to the cathode side of the multichip LED 38 via the shunt resistor R1 and an output terminal 52. The output terminal 52 is coupled to the control circuit 16 via a current detection terminal 54. The shunt resistor R1 is configured as a current detection means for detecting a current flowing into the multichip LEDs 32 to 38 in a manner that a voltage generated across the shunt resistor R1 is fed back to the control circuit 16 as a current of the multichip LEDs 32 to 38.

The NMOS transistor 40 is configured as a switching element which is turned on and off in response to an on/off signal (switching signal) outputted from the control circuit 16. When the NMOS transistor 40 is turned on, the input voltage from the on-vehicle battery 46 is accumulated in the transformer T1 as electromagnetic energy. When the NMOS transistor 40 is turned off, the electromagnetic energy having been accumulated in the transformer T1 is discharged as light emission energy from the secondary winding side of the transformer T1 to the multichip LEDs 32 to 38 via the diode D1.

That is, the switching regulator 12 is configured as a current supply control means which is supplied with power from the on-vehicle battery 46 together with the control circuit 16 and controls the current supply to the multichip LEDs 32 to 38. In this case, the switching regulator 12 compares the voltage of the current detection terminal 54 with a prescribed voltage and controls the output current in accordance with the comparison result.

As shown in FIG. 3, the control circuit 16 for controlling the switching regulator 12 is configured by a comparator 56, an amplifier 58, a saw-tooth wave generator 60, a reference voltage supply 62, resistors R3, R4, R5 and a capacitor C3. The output terminal 64 of the comparator 56 is coupled to the gate of the NMOS transistor 40 directly or via a current amplifying preamplifier (not shown). An input terminal 66 coupled to the one end of the resistor R3 is coupled to the current detection terminal 54. The voltage fed back from the current detection terminal 54 is applied to the input terminal 66. The resistors R3 and R4 divides the voltage applied to the input terminal 66 and applies a divided voltage to the negative input terminal of the error amplifier 58. The error amplifier 58 outputs a voltage according to a difference between the voltage applied to the negative input terminal thereof and a reference voltage of the reference voltage supply 62, to the positive input terminal of the comparator 56 as a threshold value Vth. The comparator 56 is supplied at its negative input terminal with a saw-tooth wave voltage Vs from the saw-tooth wave generator 60, then compares the saw-tooth wave voltage Vs with the threshold value Vth and outputs the on/off signal according to the comparison result to the gate of the NMOS transistor 40.

For example, as shown in FIGS. 4(*a*) and (*b*), when the level of the threshold value Vth locates at the almost center portion of the saw-tooth wave voltage Vs, the comparator outputs the on/off signal with an on-duty of about 50%. On the other hand, when the level of the voltage fed back from the current detection terminal 54 becomes lower than the reference voltage from the reference voltage supply 62 due to the reduction of the output current of the switching regulator 12, the level of the threshold value Vth outputted from the error amplifier 58 increases. Thus, as shown in FIGS. 4(*c*) and (*d*), the comparator 56 outputs the on/off signal with the on-duty of more than 50%. As a result, the output current of the switching regulator 12 increases.

In contrast, when the level of the voltage fed back from the current detection terminal 54 becomes higher than the reference voltage from the reference voltage supply 62 due to the increase of the output current of the switching regulator 12, the level of the threshold value Vth outputted from the error amplifier 58 reduces. Thus, as shown in FIGS. 4(*e*) and (*f*), the comparator 56 outputs the on/off signal with the on-duty of less than 50%. As a result, the output current of the switching regulator 12 reduces. In place of the saw-tooth wave generator 60, a triangular wave generator for generating a triangular wave (triangular wave signal) may be used.

The control circuit 16 is supplied with a power from the control power supply 14. As shown in FIG. 5, the control power supply 14 includes, as a series regulator, an NPN transistor 68, a resistor R6, a zener diode ZD1 and a capacitor C4. The collector of the NPN transistor 68 is coupled to the power supply input terminal 44 via the power supply switch 42 and the emitter thereof is coupled to the control circuit 16 via an output terminal 70. When the NPN transistor 68 is supplied with the power supply voltage from the power supply input terminal 44, this transistor outputs from the emitter a voltage according to a zener voltage generated across the both ends of the zener diode ZD1 to the control circuit 16 via the output terminal 70.

The forward voltage detection circuits 20, 22, 24 and 26 are coupled in parallel to the both ends of the multichip LEDs 32, 34, 36 and 38, and are configured as forward voltage detection means which detect forward voltages Vf (sum of forward voltages of the four LED chips) generated across the both ends of the multichip LEDs 32 to 38 and output the detection results to the microcomputer 18, respectively.

As shown in FIG. 6, for example, the forward voltage detection circuits 20 to 26 may include resistors R10, R11, R12, R13, R14, R15, R16, R17, R18, R19, R20, R21, R22, R23, R24, R25 and amplifiers 72, 74, 76, 78.

The forward voltage detection circuit 20 is configured by the operational amplifier 72 and the resistors R10, R11, R18, R19. The resistors R10, R11 divide a voltage between the output terminal 50 and the output terminal 52, and the divided voltage V1 is applied to the positive input terminal of the operational amplifier 72. The resistors R18, R19 divide the output voltage of the operational amplifier 72 with reference to the voltage of a detection terminal 80, and the divided voltage is applied to the negative input terminal of the operational amplifier 72 as a voltage for a feedback operation. A voltage representing a difference between the voltage applied to the output terminal 50 and the voltage applied to the detection terminal 80, that is, a voltage V5 generated across the both ends of the multichip LED 32 is outputted from the operational amplifier 72 to the microcomputer 18 as a forward voltage Vf.

The forward voltage detection circuit 22 is configured by the operational amplifier 74 and the resistors R12, R13, R20, R21. The resistors R12, R13 divide a voltage between the detection terminal 80 and the output terminal 52, and the divided voltage V2 is applied to the positive input terminal of the operational amplifier 74. The resistors R20, R21 divide the output voltage of the operational amplifier 74 with reference to the voltage of a detection terminal 82, and the divided voltage is applied to the negative input terminal of the operational amplifier 74 as a voltage for a feedback operation. A voltage representing a difference between the voltage applied to the detection terminal 80 and the voltage applied to the detection terminal 82, that is, a voltage V6 generated across the both ends of the multichip LED 34 is outputted from the operational amplifier 74 to the microcomputer 18 as a forward voltage Vf.

The forward voltage detection circuit 24 is configured by the operational amplifier 76 and the resistors R14, R15, R22, R23. The resistors R14, R15 divide a voltage between the detection terminal 82 and the output terminal 52, and the divided voltage V3 is applied to the positive input terminal of the operational amplifier 76. The resistors R22, R23 divide the output voltage of the operational amplifier 76 with reference to the voltage of a detection terminal 84, and the divided voltage is applied to the negative input terminal of the operational amplifier 76 as a voltage for a feedback operation. A voltage representing a difference between the voltage applied to the detection terminal 82 and the voltage applied to the detection terminal 84, that is, a voltage V7 generated across the both ends of the multichip LED 36 is outputted from the operational amplifier 76 to the microcomputer 18 as a forward voltage Vf.

The forward voltage detection circuit 26 is configured by the operational amplifier 78 and the resistors R16, R17, R24, R25. The resistors R16, R17 divide a voltage between the detection terminal 84 and the output terminal 52, and the divided voltage V4 is applied to the positive input terminal of the operational amplifier 78. The resistors R24, R25 divide the output voltage of the operational amplifier 78 with reference to the voltage of the output terminal 52, and the divided voltage is applied to the negative input terminal of the operational amplifier 78 as a voltage for a feedback operation. A voltage representing a difference between the voltage applied to the detection terminal 84 and the voltage applied to the output terminal 52, that is, a voltage V8 generated across the both ends of the multichip LED 38 is outputted from the operational amplifier 78 to the microcomputer 18 as a forward voltage Vf.

In this case, the microcomputer 18 subject the voltages V5, V6, V7, V8 to the A/D (analog to digital) conversion by an A/D converter to obtain the forward voltages Vf generated at the both ends of the multichip LEDs 32, 34, 36, 38, respectively.

The microcomputer 18 is configured by a CPU, a ROM, a RAM, an input/output circuit, the A/D converter etc. The microcomputer fetches sequentially analog voltages relating to the voltages V5, V6, V7, V8 from the forward voltage detection circuits 20, 22, 24, 26, then converts the analog voltages into digital data, and obtains the detection values of the forward voltages Vf of the multichip LEDs 32 to 38 based on the digital data thus converted, respectively. Then, the microcomputer compares the detection values of the forward voltages Vf with an abnormality determination value to determine the changes of the forward voltages Vf of the multichip LEDs 32 to 38, that is, determine whether or not there is an abnormality in any of the multichip LEDs 32 to 38 due to the reduction of the forward voltage Vf.

In this manner, the microcomputer is configured as a determination mean for determining the abnormality of the multichip LEDs. Further, the microcomputer 18 also acts as a correction means in a manner that the microcomputer fetches the voltage across the both ends of the thermistor 28 serving as a temperature detection means for detecting ambient temperature of the multichip LEDs 32 to 38, then corrects the detection values of the forward voltages Vf in accordance with the fetched voltage and sets the corrected detection values as true detection values.

The microcomputer 18 outputs the determination result to a terminal 86 when the determination is made as to whether or not the abnormality occurs in any of the multichip LEDs 32 to 38. For example, when the microcomputer determines that there occurs an abnormality, the microcomputer outputs a low impedance signal to the terminal 86. In contrast, when the microcomputer determines that there does not occur an abnormality, the microcomputer outputs a high impedance signal to the terminal 86. The terminal 86 is coupled to an LED 88 disposed at a driver's seat. The anode side of the LED 88 is coupled to the positive terminal of the on-vehicle battery 46 via a resistor R7. The LED 88 emits light when the microcomputer 18 determines that there occurs an abnormality to notify the occurrence of an abnormality to a driver.

Figure 7:
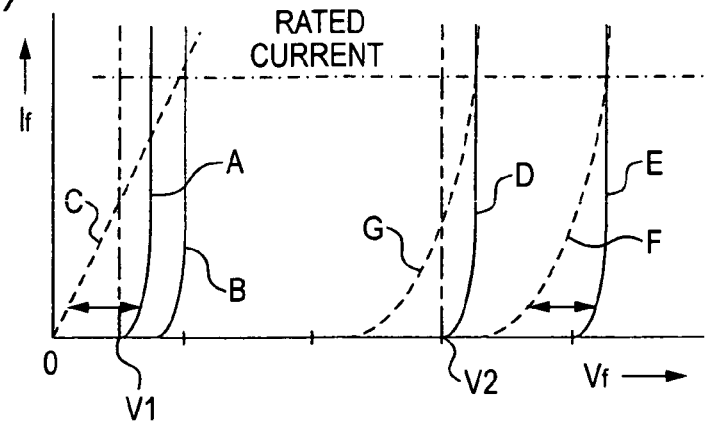
FIG. 7(*a*) is a characteristic diagram for explaining the Vf—If characteristics of an LED and an multichip LED in the case where an abnormality occurs in one LED, and FIG. 7(*b*) is a characteristic diagram for explaining the Vf—If characteristics of an LED and an multichip LED in the case where an abnormality occurs in two LEDs.
Figure 7:
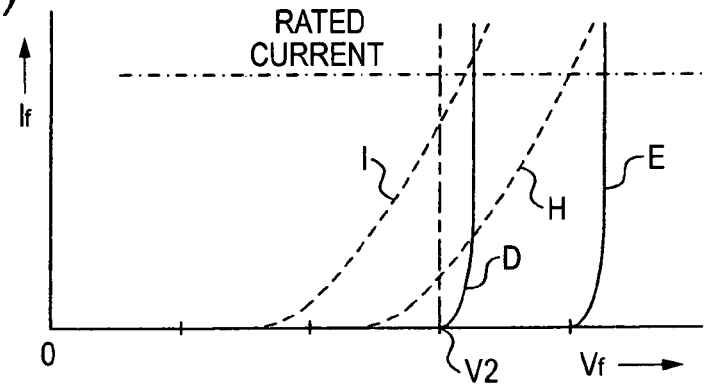

In the case where the microcomputer 18 compares the detection values of the forward voltages Vf with the abnormality determination value to determine whether or not there occurs an abnormality due to the reduction of the forward voltage Vf of one of the multichip LEDs 32 to 38, as shown in FIGS. 7(*a*) and (*b*), the abnormality determination values V1, V2 are set in view of the characteristics A to I of the forward voltages Vf and the forward currents If of the multichip LEDs 32 to 38.

In the case where a single LED is housed within a package, when the rated current as a prescribed current (forward current) flows into the LED, the forward voltage Vf varies in a range from the characteristics A to the characteristics B as shown in FIG. 7(*a*) even by taking the variance into consideration. In this case, if leak failure occurs in the single LED, the forward voltage Vf changes to the characteristics C in accordance with the impedance of the LED. That is, the change of the forward voltage Vf is small like the characteristics A and B even when the rated current as the prescribed current flows into the single LED in the normal state. However, when a current is supplied to the LED where a leak failure occurs, as shown by the characteristics C, the change of the forward voltage Vf becomes larger than the change of the forward voltage Vf in the normal state (characteristics A and B) in a region where the forward current is smaller than the rated current.

Thus, in the case where a single LED is housed within a package, the abnormality determination value V1 is set, for example, in a manner that, at the time of a leak failure in the single LED, the change of the forward voltage Vf can be detected in the region where the forward current is smaller than the rated current and this abnormality determination value is equal to or smaller than the minimum value of the forward voltage Vf in the normal state (the minimum value of the characteristics A).

On the other hand, in the case of using an LED which houses four LEDs within a package, like the multichip LEDs 32 to 38, when the rated current as the prescribed current (forward current) flows into the multichip LEDs 32 to 38, the forward voltage Vf varies in a range from the characteristics D to the characteristics E as shown in FIG. 7(*a*) even by taking the variance into consideration. In this case, if leak failure occurs in one of the multichip LEDs 32 to 38, the forward voltage Vf of the multichip LED thus failed changes to the characteristics F, G in accordance with the impedance of the multichip LED. That is, the change of the forward voltage Vf is small like the characteristics D, E even when the rated current as the prescribed current flows into the multichip LEDs 32 to 38 in the normal state.

However, if leak failure occurs in one of the multichip LEDs 32 to 38, as shown by the characteristics F and G, the change of the forward voltage Vf of the multichip LED where the leak failure occurs becomes larger than the change of the forward voltage Vf in the normal state (characteristics D to E) in the region where the forward current is smaller than the rated current. Thus, even if the abnormality determination value is set based on the change of the forward voltage Vf at the time where the rated current flows into the multichip LEDs 32 to 38 and it is determined whether or not an abnormality occurs in any of the multichip LEDs 32 to 38 in accordance with the abnormality determination value thus set, because the changing amounts of the forward voltages Vf of the multichip LEDs 32 to 38 are small, it may not be able to be determined accurately in accordance with the reduction of the forward voltage Vf whether or not an abnormality occurs in any of the multichip LEDs 32 to 38.

Accordingly, in one or more embodiments, the current restriction period setting circuit 30 sets a constant time period for supplying a current smaller than the rated current to the multichip LEDs 32 to 38 after turning the power supply switch 42 on. Then, the forward voltages Vf of the multichip LEDs 32 to 38 are detected during this setting time period. Then, based on the detection result of the forward voltage and a abnormality determination value V2 (the forward voltage corresponding to the forward current in a region smaller than the rated current) set in accordance with the characteristics F and G shown in FIG. 7, the microcomputer 18 determines whether or not an abnormality occurs in any of the multichip LEDs 32 to 38 due to the reduction of the forward voltage Vf, for example, as an abnormality caused by the change of the forward voltage of the semiconductor light source.

In this case, the abnormality determination value V2 is set, for example, in a manner that, in the case where leak failure occurs in one of the multichip LEDs 32 to 38, the change of the forward voltage Vf can be detected in the region where the forward current is smaller than the rated current and this abnormality determination value is set in correspondence to a value equal to or smaller than the minimum value of the forward voltage Vf in the normal state (the minimum value of the characteristics D). Thus, it can be detected whether or not leak failure occurs in one of the multichip LEDs 32 to 38 by comparing the forward voltages Vf of the multichip LEDs 32 to 38 with the abnormality determination value V2.

Further, if leak failure occurs in two of the multichip LEDs 32 to 38, as shown by the characteristics H and I in FIG. 7(*b*), the changes of the forward voltages Vf of the multichip LEDs where the leak failure occur become larger than the change of the forward voltage Vf (characteristics D to E) in the normal state and the change of the forward voltage Vf in the case where the leak failure occur in one of the multichip LEDs 32 to 38, in the region where the forward current is smaller than the rated current. In this case, the abnormality determination value V2 is set in a manner that, in the case where leak failure occurs in two of the multichip LEDs 32 to 38, the change of the forward voltage Vf can be detected in the region where the forward current is smaller than the rated current and this abnormality determination value is set in correspondence to a value equal to or smaller than the minimum value of the forward voltage Vf in the normal state (the minimum value of the characteristics D). Thus, it can be detected whether or not leak failure occurs in one of the multichip LEDs 32 to 38 even when a leak failure occurs in two of the multichip LEDs 32 to 38.

As shown in FIG. 8, the current restriction period setting circuit 30 is configured by an NMOS transistor 90, resistors R8, R9, R10 and capacitors C5, C6. The one end side of the resistor R8 is coupled to the output terminal 52, and the coupling point between the resistor R8 and the capacitor C5 is coupled to the current detection terminal 54. The NMOS transistor 90 is configured in a manner that the source thereof is grounded, the drain thereof is coupled to the current detection terminal 54 via the resistor R9 and the gate thereof is coupled to the positive terminal of the on-vehicle battery 46 via the resistor R10, the power supply switch 42 and the power supply input terminal 44. In order to improve the resist voltage of the gate of the NMOS transistor 90, a resistor or a zener diode may be inserted between the gate and the source thereof so as to divide the gate voltage. Although the output of the power supply switch 42 is applied to the gate of the NMOS transistor 90 via the resistor R10, the output of the control power supply 14 may be applied to the gate of the NMOS transistor 90.

The current restriction period setting circuit 30 is arranged in a manner that when the NMOS transistor 90 is turned on, the voltage of the output terminal 52 is divided by the resistor R8 and the resistor R9, and the divided voltage is applied to the current detection terminal 54 as a voltage for supplying the rated currents to the multichip LEDs 32 to 38. In contrast, when the voltage of the output terminal 52 is not divided by the resistor R8 and the resistor R9, the current restriction period setting circuit is arranged in a manner that the voltage of the output terminal 52 is applied to the current detection terminal 54 via the resistor R8 as a voltage for supplying a current smaller than the rated currents to the multichip LEDs 32 to 38.

When the power supply switch 42 is turned on, although each of the switching regulator 12, the control power supply 14 and the control circuit 16 turns on immediately, the NMOS transistor 90 is in an off state for a constant period, that is, a constant time period (the constant period determined by a time constant defined by the resistor R10 and the capacitor C6 constituting a low pass filter). When the NMOS transistor 90 is in the off state, the voltage of the output terminal 52 is applied to the current detection terminal 54 via the resistor R8 without being divided. In the case where the divided voltage obtained by dividing the voltage of the output terminal 52 by the resistors R8 and R9 is applied to the current detection terminal 54, if the control circuit 16 executes a control for making the voltage at the current detection terminal 54 constant, the switching regulator 12 supplies a current smaller than the rated current to each of the multichip LEDs 32 to 38. In this case, the forward voltages Vf of the multichip LEDs 32 to 38 are detected by the forward voltage detection circuits 20 to 26, respectively, then the microcomputer 18 compares each of the respective detection results with the abnormality determination value V2 and outputs the comparison results. In this case, if leak failure occurs in one of the multichip LEDs 32 to 38, the forward voltage Vf of the LED in which the leak failure occurs changes in accordance with the characteristics F or G and becomes smaller than the abnormality determination value V2. Thus, an abnormality due to the reduction of the forward voltage Vf at the LED in which the leak failure occurs can be accurately detected.

On the other hand, in a process where the gate voltage of the NMOS transistor 90 increases gradually after the power supply switch 42 is turned on, when the constant period, that is, the constant time period passes and so the gate voltage exceeds a threshold value, the NMOS transistor 90 turns on. When the NMOS transistor 90 turns on, the voltage of the output terminal 52 is divided by the resistors R8 and R9 and the divided voltage is applied to the current detection terminal 54. The voltage applied to the current detection terminal 54 in this case is lower than that in a case where the NMOS transistor 90 is in the off state. Thus, if the control circuit 16 executes the control for making the voltage at the current detection terminal 54 constant, the switching regulator 12 supplies the rated current as the prescribed current (forward current) to the multichip LEDs 32 to 38.

According to one or more embodiments, there is provided with a time period during which the switching regulator 12 supplies the current smaller than the rated current to the multichip LEDs 32 to 38 for the constant period, that is, the constant time period after the power supply switch 42 is turned on, then the forward voltages Vf of the multichip LEDs 32 to 38 are detected during this time period, and the microcomputer 18 compares the respective detection results with the abnormality determination value V2. Thus, if leak failure occurs in one of the multichip LEDs 32 to 38, the forward voltage Vf of the LED in which the leak failure occurs changes in accordance with the characteristics F or G and becomes smaller than the abnormality determination value V2. Accordingly, it can be determined (detected) with a high accuracy that an abnormality due to the reduction of the forward voltage Vf occurs in the multichip LEDs 32 to 38.

Further, in one or more embodiments, the forward voltage detection circuits 20 to 26 detect the forward voltages Vf of the multichip LEDs 32 to 38 and the microcomputer 18 compares the respective detection results with the abnormality determination value. However, if an embodiment of the invention employs a configuration that the microcomputer 18 compares the forward voltage Vf generated between the output terminals 50 and 52 (the sum of the forward voltages Vf of the multichip LEDs 32 to 38) with an abnormality determination value (an abnormality determination value corresponding to a value larger than the abnormality determination value V2 used in the case of detecting the forward voltages Vf of the multichip LEDs 32 to 38 but smaller than the sum of the forward voltages Vf of the multichip LEDs 32 to 38 in the normal state), it can be determined (detected) with a high accuracy without providing the forward voltage detection circuits 20 to 26 that an abnormality due to the reduction of the forward voltage occurs in any of the multichip LEDs 32 to 38.

Embodiments may employ, as the semiconductor light source, an arrangement configured by a semiconductor light emitting element (LED) and a static electricity protection element (zener diode) coupled in parallel to the semiconductor light emitting element. In this case, even if the semiconductor light emitting element is normal, when an abnormality occurs in the static electricity protection element coupled in parallel to the semiconductor light emitting element, the voltage across the both terminals of the static electricity protection element drops. Thus, the voltage (forward voltage) across the both terminals of the static electricity protection element in which an abnormality occurs is regarded as the forward voltage of the semiconductor light emitting element. Therefore, even if there occurs an abnormality due to the change of the forward voltage of the static electricity protection element, it can be determined (detected) with a high accuracy that an abnormality occurs due to the reduction of the forward voltage of the semiconductor light source.

Next, other embodiments of the invention will be explained based on FIGS. 9 to 11. As shown in FIG. 9, one or more embodiments employ a semiconductor light source, in place of the multichip LEDs 32 to 38, which is formed by the parallel connection of LEDs 92, 94, 96, 98, 100 serving as semiconductor light emitting elements and zener diodes ZD2, ZD3, ZD4, ZD5, ZD6, for example, serving as static electricity protection elements. When the power supply switch 42 is turned on, the starting of the switching regulator 12 is stopped for a constant period, that is, a constant time period after the turning-on of the power supply switch. During this time period, an auxiliary current supply circuit (auxiliary current supply means) 102 supplies a reverse current to the LEDs 92, 94, 96, 98, 100 and a forward current to the zener diodes ZD2, ZD3, ZD4, ZD5, ZD6, whereby an abnormality determination circuit (determination means) 104 determines whether or not there arises an abnormality in the LEDs 92, 94, 96, 98, 100 or the zener diodes ZD2, ZD3, ZD4, ZD5, ZD6. The control power supply 14 is provided with a power supply restriction circuit (starting stop period setting means) 106 in order to stop the starting of the switching regulator 12 for the constant period.

In order to set the anode side of the LED 92 to a reference voltage=0 volt and also set the output of the switching regulator 12 to the negative polarity (negative polarity with respect to the reference voltage=0 volt), as shown in FIG. 10, a shunt resistor R1 is inserted between the transformer T1 of the switching regulator 12 and the output terminal 50. Further, the cathode side of the diode D1 is coupled to the transformer T1 and the anode side thereof is coupled to the output terminal 52, and the negative polarity output of the switching regulator 12 is applied to the both ends of the series connection of the LEDs 92, 94, 96, 98, 100.

As shown in FIG. 11, the power supply restriction circuit 106 is configured by an NMOS transistor 108, capacitors C7, C8 and resistors R30, R31. The one end side of each of the capacitors C7, C8 is coupled to the power supply switch 42, the coupling point between the resistor R30 and the resistor R31 is coupled to the base of the NMOS transistor 108 constituting an emitter follower, and the collector of the NMOS transistor 108 is coupled to the cathode side of the zener diode ZD1 of the control power supply 14. When the power supply switch 42 is turned on, the NMOS transistor 108 is turned on in response to a pulse applied to the capacitor C8. In this case, the NMOS transistor 108 is in an on-state only during a period corresponding to a time constant defined by a series circuit of the capacitor C8 and the resistors R30, R31, and thereafter shifts to an off-state in accordance with the reduction of the base voltage thereof. When the NMOS transistor 108 is turned on in response to the tuning-on of the power supply switch 42, the base of the NPN transistor 68 is grounded via the NMOS transistor 108, whereby the control power supply 14 stops the application of the voltage from the output terminal 70 thereof to the control circuit 16 for the constant period. Thus, the starting of the switching regulator 12 is stopped for a time period where the NMOS transistor 108 is in the on state.

As shown in FIG. 9, the auxiliary current supply circuit 102 is configured by resistors R26, R27 and a zener diode ZD7. The cathode of the zener diode ZD7 is coupled to the coupling point between the resistors R26 and R27. An input terminal 110 coupled to the one end side of the resistor R26 is coupled to the power supply switch 42. The one end side of the resistor R27 is coupled to the cathode side of the LED 100, the anode side of the zener diode ZD6 and the output terminal 52. When the power supply switch 42 is turned on, a voltage (+B) applied to the input terminal 110 is clamped by the zener diode ZD6. The clamped voltage is applied to the LEDs 92 to 10 as a reverse voltage and also applied to the zener diodes ZD2 to ZD6 as a forward voltage. In this case, a current smaller than the rated current as the prescribed current flows through the zener diodes ZD2 to ZD6, then the abnormality determination circuit 104 compares the forward voltage Vf of the entirety of the zener diodes ZD2 to ZD6 (sum of the forward voltages of the five zener diodes ZD2 to ZD6) with an abnormality determination value. In this case, the LEDs 92 to 100 are coupled in parallel to zener diodes ZD2 to ZD6, respectively. Thus, if leak failure occurs in the LED when a reverse voltage is applied across the LEDs 92 to 100, even when the zener diode coupled in parallel to the LED where the leak failure occurs is normal, the forward voltage Vf of this normal zener diode reduces. Accordingly, the forward voltage Vf of the entirety of the zener diodes ZD2 to ZD6 contains the forward voltage Vf of the LED where the leak failure occurs.

As shown in FIG. 9, the abnormality determination circuit 104 is configured by an NPN transistor 112, a lowpass filter 114, a latch circuit 116, a zener diode ZD8 and resistors R28, R29. The NPN transistor 112 is arranged in a manner that the collector thereof is coupled to the lowpass filter 114 and the latch circuit 116, the emitter thereof is grounded via the zener diode ZD8, and the base thereof is coupled to the cathode side of the LED 100, the anode side of the zener diode ZD6 and the output terminal 52 of the switching regulator 12 via the resistor R28.

The abnormality determination circuit 104 uses: (the sum of the zener voltage of the zener diode ZD8 and the base/emitter voltage VBE of the NPN transistor 112) as the abnormality determination value. The abnormality determination value is set in view of the characteristics C of FIG. 7. That is, when leak failure occurs in one of the zener diodes ZD2 to ZD6, the forward voltage Vf of the zener diode where the leak failure occurs changes in accordance with the characteristics C almost like the LED. Thus, the abnormality determination value is set based on the sum of the total value of the forward voltages Vf in a case where four zener diodes of the five zener diodes ZD2 to ZD6 are in a normal state and the forward voltage corresponding to a forward current in the region smaller than the rated current of the characteristics C of FIG. 7.

When the starting of the switching regulator 12 is stopped during the constant period, that is, the constant time period after the power supply switch 42 is turned on, the auxiliary current supply circuit 102 supplies the reverse current to the LEDs 92 to 100 and supplies a current smaller than the rated current to the zener diodes ZD2 to ZD6 as the forward current. Then, the abnormality determination circuit 104 compares the entire forward voltage Vf of the zener diodes ZD2 to ZD6 (sum of the forward voltages of the five zener diodes ZD2 to ZD6) with the abnormality determination value. As a result of the comparison, when the entire forward voltage Vf of the zener diodes ZD2 to ZD6 (sum of the forward voltages of the five zener diodes ZD2 to ZD6) exceeds the abnormality determination value, the abnormality determination circuit 104 determines that each of the LEDs 92 to 100 and the zener diodes ZD2 to ZD6 is normal, whereby the NPN transistor 112 is in an off state, whilst the output of each of the lowpass filter 114 and the latch circuit 116 is at a high level.

On the other hand, when the entire forward voltage Vf of the zener diodes ZD2 to ZD6 (sum of the forward voltages of the five zener diodes ZD2 to ZD6 and including the forward voltages of the LEDs 92, 94, 96, 98, 100 respectively coupled in parallel to the zener diodes ZD2, ZD3, ZD4, ZD5, ZD6) is smaller than the abnormality determination value, the abnormality determination circuit 104 determines that a failure occurs at one of the LEDs 92 to 100 or one of the zener diodes ZD2 to ZD6 to turn the NPN transistor 112 on. When the NPN transistor 112 turns on, the output of each of the lowpass filter 114 and the latch circuit 116 changes to a low level from a high level and so the terminal 86 becomes low level. Thus, the LED 8 turns on to notify a driver that leak failure occurs at one of the zener diodes ZD2 to ZD6.

Further, when the control power supply 14 turns on upon the lapse of the constant period, that is, the constant time period after the power supply switch 42 is turned on, the switching regulator 12 starts and outputs the voltage of negative polarity from the output terminal 52 thereof. Thus, the NPN transistor 112 of the abnormality determination circuit 104 is forcedly turned off and maintains the off state. In this case, the lowpass filter 114 is placed in a non-operation state in accordance with the turning-on of the control power supply 14.

According to one or more embodiments, when the power supply switch 42 is turned on, the starting of the switching regulator 12 is stopped for the constant period, that is, the constant time period after the turning-on of the power supply switch. During this time period, the auxiliary current supply circuit 102 supplies the reverse current to the LEDs 92, 94, 96, 98, 100 and supplies the forward current smaller than the rated current to the zener diodes ZD2, ZD3, ZD4, ZD5, ZD6. Further, during this time period, sum of the forward voltages of the zener diodes ZD2, ZD3, ZD4, ZD5, ZD6 (including the forward voltages of the LEDs 92, 94, 96, 98, 100 respectively coupled in parallel to the zener diodes ZD2, ZD3, ZD4, ZD5, ZD6) is detected, and the abnormality determination circuit 104 compares this detection result with the abnormality determination value. Thus, when leak failure occurs at one of the LEDs 92, 94, 96, 98, 100 or one of the zener diodes ZD2, ZD3, ZD4, ZD5, ZD6, the forward voltage Vf of the LED or the zener diode where the leak failure occurs changes in accordance with the characteristics C, and so the forward voltage of the entirety (sum) of the zener diodes ZD2, ZD3, ZD4, ZD5, ZD6 (including the forward voltages of the LEDs 92, 94, 96, 98, 100 respectively coupled in parallel to the zener diodes ZD2, ZD3, ZD4, ZD5, ZD6) becomes smaller than the abnormality determination value. Thus, it can be detected with a high accuracy that, whether or not an abnormality occurs due to the change of the forward voltage of the semiconductor light source, an abnormality occurs due to the reduction of the forward voltage Vf at one of the LEDs 92, 94, 96, 98, 100 or one of the zener diodes ZD2, ZD3, ZD4, ZD5, ZD6 of the semiconductor light source, for example.

In one or more embodiments, the forward voltage of the entirety (sum) of the zener diodes ZD2, ZD3, ZD4, ZD5, ZD6 is compared with the abnormality determination value. However, embodiments of the present invention may be configured so as to include a plurality of forward voltage detection circuits for detecting the forward voltages of the zener diodes ZD2, ZD3, ZD4, ZD5, ZD6 (including the forward voltages of the LEDs 92, 94, 96, 98, 100 respectively coupled in parallel to the zener diodes ZD2, ZD3, ZD4, ZD5, ZD6) and a plurality of comparators for comparing the forward voltages Vf detected by the forward voltage detection circuits with an abnormality determination value (an abnormality determination value corresponding to a single zener diode), respectively. When such a configuration is employed, it can be detected with a high accuracy whether or not an abnormality occurs due to the reduction of the forward voltage Vf of the zener diodes ZD2, ZD3, ZD4, ZD5, ZD6 or the LEDs 92, 94, 96, 98, 100.

DESCRIPTION OF THE REFERENCE NUMERALS AND SIGNS

10 lighting control apparatus for vehicle lighting device
12 switching regulator
14 control power supply
16 control circuit
18 microcomputer
20, 22, 24, 26 forward voltage detection circuit
30 current restriction period setting circuit
32, 34, 36, 38 multichip LED
92, 94, 96, 98, 100 LED
102 auxiliary current supply circuit
104 abnormality determination circuit
106 power supply restriction circuit While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A lighting control apparatus for a vehicle lighting device, comprising:

current supply control means for controlling supply of a current to a semiconductor light source including a semiconductor light emitting element;

current restriction period setting means for setting, to the current supply control means, a period for restricting the current to be supplied to the semiconductor light source to a value smaller than a prescribed current; and determination means for comparing a forward voltage generated from the semiconductor light source during the period set by the current restriction period setting means with an abnormality determination value to determine whether or not an abnormality occurs due to a change of the forward voltage of the semiconductor light source.

2. A lighting control apparatus for a vehicle lighting device, comprising:

current supply control means for controlling supply of a current to a semiconductor light source including a semiconductor light emitting element and a static electricity protection element coupled in parallel to the semiconductor light emitting element;

current restriction period setting means for setting, to the current supply control means, a period for restricting the current to be supplied to the semiconductor light source to a value smaller than a prescribed current; and determination means for comparing a forward voltage generated from the semiconductor light source during the period set by the current restriction period setting means with an abnormality determination value to determine whether or not an abnormality occurs due to a change of the forward voltage of the semiconductor light source.

3. A lighting control apparatus for a vehicle lighting device, comprising:

current supply control means for controlling supply of a current to a semiconductor light source including a semiconductor light emitting element and a static electricity protection element coupled in parallel to the semiconductor light emitting element;

starting stop period setting means for setting, to the current supply control means, a starting stop period during which a supply of a current to the semiconductor light source is stopped;

auxiliary current supply means for supplying, during the starting stop time period, to the semiconductor light source, a current that flows through the static electricity protection element in a forward direction and flows through the semiconductor light emitting element in a backward direction and is smaller than a prescribed current; and determination means for comparing a forward voltage generated from the semiconductor light source during the starting stop period with an abnormality determination value to determine whether or not an abnormality occurs due to a change of the forward voltage of the semiconductor light source.

4. A lighting control apparatus for a vehicle lighting device according to claim 1, wherein the abnormality determination value is a value set based on a forward voltage when a forward current of the semiconductor light emitting element is in a region smaller than the prescribed current.

5. A lighting control apparatus for a vehicle lighting device according to claim 3, wherein the abnormality determination value is a value set based on a forward voltage when a forward current of the static electricity protection element is in a region smaller than the prescribed current.

6. A lighting control apparatus for a vehicle lighting device according to claim 2, wherein the abnormality determination value is a value set based on a forward voltage when a forward current of the semiconductor light emitting element is in a region smaller than the prescribed current.

7. A lighting control apparatus for a vehicle lighting device according to claim 1, wherein the current supply control means supplies a current to a plurality of semiconductor light sources each including a semiconductor light emitting element.

8. A lighting control apparatus for a vehicle lighting device according to claim 2, wherein the current supply control means supplies a current to a plurality of semiconductor light sources each including a semiconductor light emitting element.

9. A lighting control apparatus for a vehicle lighting device according to claim 3, wherein the current supply control means supplies a current to a plurality of semiconductor light sources each including a semiconductor light emitting element.

10. A lighting control apparatus for a vehicle lighting device, comprising:

a semiconductor light source including a semiconductor light emitting element;

a current supply controller coupled between a power supply and the semiconductor light source, wherein supply of a current from the power supply to the semiconductor light source is restricted by the current supply controller during a current restriction period to a value smaller than a prescribed current; and a microcomputer that compares a forward voltage generated from the semiconductor light source during the current restriction period with an abnormality determination value to determine whether or not an abnormality occurs due to a change of the forward voltage of the semiconductor light source.

11. A lighting control apparatus for a vehicle lighting device according to claim 10, wherein the abnormality determination value is a value set based on a forward voltage when a forward current of the semiconductor light emitting element is in a region smaller than the prescribed current.

12. A lighting control apparatus for a vehicle lighting device, comprising:

a semiconductor light source including a semiconductor light emitting element and a static electricity protection element coupled in parallel to the semiconductor light emitting element;

a current supply controller coupled between a power supply and the semiconductor light source;

wherein supply of a current to the semiconductor light source is restricted during a restriction period to a value smaller than a prescribed current; and a microcomputer that compares a forward voltage generated from the semiconductor light source during the current restriction period with an abnormality determination value to determine whether or not an abnormality occurs due to a change of the forward voltage of the semiconductor light source.

13. A lighting control apparatus for a vehicle lighting device according to claim 12, wherein the abnormality determination value is a value set based on a forward voltage when a forward current of the semiconductor light emitting element is in a region smaller than the prescribed current.

14. A lighting control apparatus for a vehicle lighting device, comprising:

a semiconductor light source including a semiconductor light emitting element and a static electricity protection element coupled in parallel to the semiconductor light emitting element a current supply controller coupled between a power supply and the semiconductor light source;

an auxiliary current supply circuit coupled between the power supply and the semiconductor light source, wherein during a stop period supply of a current from the current supply controller to the semiconductor light source is stopped, and wherein during the stop period supply of a current from the auxiliary current supply circuit that flows through the static electricity protection element in a forward direction, flows through the semiconductor light emitting element in a backward direction, and is smaller than a prescribed current is supplied; and a microcomputer that compares a forward voltage generated from the semiconductor light source during the stop period with an abnormality determination value to determine whether or not an abnormality occurs due to a change of the forward voltage of the semiconductor light source.

15. A lighting control apparatus for a vehicle lighting device according to claim 14, wherein the abnormality determination value is a value set based on a forward voltage when a forward current of the static electricity protection element is in a region smaller than the prescribed current.

16. A method of lighting control for a vehicle lighting device including a semiconductor light source, the method comprising:

restricting supply of a current from a power supply to the semiconductor light source during a current restriction period to a value smaller than a prescribed current; and comparing a forward voltage generated from the semiconductor light source during the current restriction period with an abnormality determination value to determine whether or not an abnormality occurs due to a change of the forward voltage of the semiconductor light source.

17. The method of lighting control for a vehicle lighting device according to claim 16, further comprising setting the abnormality determination value based on a forward voltage when a forward current of the semiconductor light emitting element is in a region smaller than the prescribed current.

18. A method of lighting control for a vehicle lighting device including a semiconductor light emitting element and a static electricity protection element coupled in parallel to the semiconductor light emitting element, the method comprising:

stopping, during a stop period, supply of a current to the semiconductor light source, and supplying, during the stop period, an auxiliary current that flows through the static electricity protection element in a forward direction, flows through the semiconductor light emitting element in a backward direction, and is smaller than a prescribed current is supplied; and comparing a forward voltage generated from the semiconductor light source during the stop period with an abnormality determination value to determine whether or not an abnormality occurs due to a change of the forward voltage of the semiconductor light source.

19. The method of lighting control for a vehicle lighting device according to claim 18, further comprising setting the abnormality determination value based on a forward voltage when a forward current of the static electricity protection element is in a region smaller than the prescribed current.

* * * * *